US006533498B1

(12) United States Patent
Quin

(10) Patent No.: US 6,533,498 B1
(45) Date of Patent: Mar. 18, 2003

(54) REINFORCED COMPOSITE MATERIAL

(76) Inventor: Donald S. Quin, 4122 Tuxedo Dr., Victoria, B.C. (CA), V8X 2M1

( * ) Notice: Subject to any disclaimer, the term of this patent is extended or adjusted under 35 U.S.C. 154(b) by 0 days.

(21) Appl. No.: 09/643,828

(22) Filed: Aug. 22, 2000

(30) Foreign Application Priority Data

Mar. 20, 2000 (CA) ..... 2301361

(51) Int. Cl.[7] ..... E01F 5/00
(52) U.S. Cl. ..... 405/125; 405/124
(58) Field of Search ..... 405/124, 125, 405/126, 127, 53, 284, 286; 249/10, 11, 12

(56) References Cited

U.S. PATENT DOCUMENTS

| | | | | | |
|---|---|---|---|---|---|
| 354,897 | A | * | 12/1886 | Goodridge, Jr. | 405/125 |
| 567,653 | A | * | 9/1896 | Parker | 405/125 |
| 786,059 | A | * | 3/1905 | Simpson | 405/125 |
| 1,074,492 | A | * | 9/1913 | Countryman | 249/12 |
| 1,144,200 | A | * | 6/1915 | Hewett | 405/125 |
| 1,384,514 | A | * | 7/1921 | Close | 249/12 |
| 1,389,543 | A | * | 8/1921 | Zaun | 249/12 |
| 1,407,246 | A | * | 2/1922 | Bond | 249/12 |
| 2,041,267 | A | | 5/1936 | Schroeder, Jr. | |
| 2,636,352 | A | * | 4/1953 | Alger | 405/125 |
| 3,779,021 | A | | 12/1973 | Green | |
| 4,723,871 | A | | 2/1988 | Roscoe | |
| 4,993,872 | A | | 2/1991 | Lockwood | |
| 5,536,113 | A | | 7/1996 | McGregor | |
| 5,551,798 | A | | 9/1996 | Goodreau | |
| 5,836,717 | A | | 11/1998 | Bernini | |
| 5,971,663 | A | | 10/1999 | Brothers | |
| D447,543 | S | * | 9/2001 | Quin | D23/259 |
| D447,544 | S | * | 9/2001 | Quin | D23/259 |

FOREIGN PATENT DOCUMENTS

| | | | | |
|---|---|---|---|---|
| GB | 2076867 A | * | 5/1980 | E02B/11/00 |
| GB | 2183775 A | * | 10/1986 | E02B/11/00 |

* cited by examiner

*Primary Examiner*—Robert E. Pezzuto
*Assistant Examiner*—Alexandra K. Pechhold
(74) *Attorney, Agent, or Firm*—Robert H. Barrigar

(57) ABSTRACT

A headwall structure constructed of lightweight reinforced composite and incorporating a rigid polymer concrete core in selected portions, for use with standard culvert or drainage pipes in infrastructure water management systems in substitution for conventional concrete headwalls. The headwall structure has a vertical back wall with an integral spigot or pipe stub surrounding a central orifice. The pipe stub is preferably cross-sectionally dimensioned and configured to be identical to a selected standard pipe section end so that such pipe section can be connected to the pipe stub without an adapter. A tray is joined to the lower edge of the back wall. A pair of outwardly flared sidewalls are joined to the back wall and to the tray. Angled brace panels extending from the sidewalls to the tray reinforce the sidewalls. The tray, sidewalls and brace panels define the water channels. Front and side brace panels define a recess into which earth enters and against which earth bears to provide stabilization. The sidewalls and all or selected ones of the brace panels may be curved to form a curved continuum. The structure may be a one-piece structure or a two-component structure, the latter preferably including as one of the two components the spigot with a surrounding flanged wall receivable by a mating aperture in the back wall of the other component that includes the remaining elements of the headwall structure.

40 Claims, 15 Drawing Sheets

REINFORCED COMPOSITE MATERIAL

FIELD OF THE INVENTION

This invention relates to headwall structures and in particular to improved lightweight headwall structures used with standard culvert or drainage pipes in infrastructure water management system. Because they are lightweight while having adequate strength, headwall structures according to the invention are easily transported and installed. They may be largely prefabricated. They are intended to be used in substitution for standard heavy concrete headwalls.

BACKGROUND OF THE INVENTION

Headwalls are structures that attach to the end of a culvert or drainage pipe and support the surrounding earth or fill, thus preventing or impeding local erosion and undercutting of the bank around the culvert, thereby minimising the risk of serious washout. These structures also facilitate the attachment of auxiliary components, e.g., trash gates for debris and animal control, security grids for prevention of entry into culvert or pipe, weir boards for use in control of water flow and levels in agricultural installations, etc. Such structures include a back wall having an orifice to receive a culvert or pipe, and often include a tray joined to the lower edge of the back wall and extending outwards therefrom and may have two outwardly flared (diverging) wings or sidewalls joined to the back wall and to the tray to retain and stabilize the surrounding earth or fill side wings for earth bank stabilization. The wings and tray when present as part of a headwall structure used as an outflow (exit) structure downstream of the culvert or pipe, direct the outflow received from the pipe or culvert away from the headwall. If used as entrance structures upstream of the pipe, such headwall structures receive water from a source such as an open ditch or drain and direct the water into the orifice and thence into a connected pipe if such is present.

Conventionally such headwall structures are made of relatively heavy concrete either formed in place or precast. It is well known that structures formed in place are labour-intensive and may also require prolonged traffic diversion if they have to be erected in association with a road in use. Because of their heavy weight, precast concrete structures require heavy-duty equipment to transport, handle and install. Additionally, concrete has several disadvantages. It is rigid and prone to cracking in the event of earth movement due to seismic events or subsidence or due to permafrost conditions in northern areas. Concrete is not environmentally friendly due to leaching of material into the ground water. It is also highly porous and subject to spalling and salt absorption.

A representative conventional culvert with associated concrete headwall can be found in U.S. Pat. No. 4,993,872 to Lockwood; this patent discloses a prefabricated headwall but without a pipe. A concrete headwall for use with a connected pipe is disclosed in U.S. Patent No. 3,779,021 to Green. An alternative concrete structure for connection to a pipe is disclosed in U.S. Pat. No. 5,551,798 to Goodreau. On occasion the use of plastics materials for coupling pipe to another structure has been proposed; see for example U.S. Pat. No. 5,971,663 to Brothers.

The Green patent discloses headwalls manufactured by pouring concrete into a light plastic prefabricated form. This method substantially reduces the amount of labour required to build the headwall, but still requires considerable time and effort, because the concrete has to be transported to the site.

Poured-in-place concrete is increasingly unacceptable because of potential negative environmental and ecological impact on wildlife habitats and drinking water quality. Note that the Green design, because of the complexity of surface detail, would not readily accommodate after-market add-on auxiliary devices such as trash gates, security grids and weir boards.

Goodreau's disclosed structure embodies two prefabricated end walls of the culvert with a specific retainer system; his structure suffers from the inherent disadvantages of using concrete slabs. Goodreau does not disclose the use of sidewalls or wings that retain the adjacent earth bank, so there could be a tendency for the earth bank to spill over the flat bottom portion of the headwall outlet area. Goodreau's design does not retain side bank slope material nor minimize ingress into pipe opening, nor does it provide complete retention of the integrity of the side slope. His headwall may not be suitable for permafrost or boggy areas without some modification, because his footings appear to be inadequate for the weight of the precast concrete unit. The structural stability of the Goodreau design is reliant on the stability of the backfill material, as no other means of supporting the headwalls to remain vertical is apparent other than the pipe connection itself.

Other patents disclosing prefabricated concrete headwall structures, mostly for use with box culvert systems or other channel constructions, include U.S. Pat. Nos. 2,041,267 to Schroeder, and 5,836,717 to Bernini.

An inexpensive headwall constructed from material other than concrete was proposed in U.S. Pat. No. 4,723,871 by Roscoe. This headwall for culverts consists of a substantially monolithic plastics shell structure, filled with a granular material or a flowable material capable of solidifying. This specific headwall is simpler and lighter than many known before it; however, it does not provide reliable performance in use. Roscoe's design does not offer full bank retention nor prevent undermining of the structure from water flow, as it does not provide wing walls nor an extended base. Further, Roscoe's design does not permit rapid installation under adverse weather conditions; yet once installed, it cannot be readily removed if need be. The manufacture in place of the Roscoe structure may not be economically viable in remote areas nor environmentally acceptable in maintaining non-contamination of water systems from poured-in-place materials during installation.

In short, while various previously known designs have utility, they all suffer from disadvantages. A strong, reliable, lightweight, easily transported and easily installed structure is needed that will provide adequate bank stabilization and adequate downstream water diversion away from the surrounding earth or fill. Such structure should be readily connectable to associated pipe and should be readily capable of receiving auxiliary devices such as trash gates, security grids and weir boards for attachment thereto. A problem to overcome is that while reinforced concrete structures are sufficiently heavy to tend to stay in place and sufficiently strong and rigid to maintain structural stability under load, a lightweight unit designed to serve the same purpose as a given concrete headwall may lack inherent structural stability and may not readily withstand the forces imparted to it in use.

SUMMARY OF THE INVENTION

A principal object of the present invention is to provide a headwall structure that meets the foregoing need and overcomes the disadvantages of conventional headwalls. Such structure should facilitate the control of water flow, erosion, flooding, silt and debris and should be readily attachable to any culvert pipe of any type, size or style, used in an infrastructure water management system.

Another object of the present invention is to provide a headwall that is economical, efficient, easy to install, and also easy to remove to accommodate the possibility of future reclamation of areas to their natural state.

Another object of the present invention is to provide a headwall structure with earth-stabilizing sidewalls and a bottom plate or tray providing in combination with the sidewall configuration (including associated reinforcing elements preferably integrally formed therewith) a suitable water flow channel that serves either as an outlet chute defining a satisfactory exit channel configuration for water outflow, or when used in reverse (entrance) orientation, a satisfactory inlet flow channel configuration.

Yet another object of the present invention is to provide a headwall of relatively light weight and therefore relatively well suited for use in areas subject to permafrost or high-water-table areas as compared with conventional concrete structures.

Such headwall should be suitable for use in many different types of terrain, possibly even in some areas of unstable ground. Such structure should provide good earth or fill anchorage in fast-flow situations.

In accordance with the foregoing objectives, one preferred embodiment of a headwall according to the invention is formed as an integral prefabricated structure preferably using a composite of plastics material and glass fibers, and preferably incorporating selected cores of selected core material in selected portions of the structure, especially where additional mass, rigidity or strength is required—typically in those portions of the structure that may be expected to be under load. Instead of steel bar reinforcement that is conventional in the manufacture of precast reinforced concrete, different cores of different materials can be used, depending upon the situation. One option is to use a polymer concrete core material that is reinforced by incorporating a composite laminate fully encapsulating the polymer concrete and that can be incorporated selectively to form a relatively rigid skeleton or framework that supports the composite laminate material overlying the polymer concrete.

While a preferred headwall structure according to the invention is preferably formed as an integral unit, such structure may be thought of as comprising a number of interconnected members including a generally vertical back wall optionally incorporating a pipe-receiving orifice, a tray joined to the lower edge of the back wall and extending generally horizontally outwardly therefrom, and a pair of sidewalls on either side of and joining both the back wall and the outlet tray. The tray may be a generally planar continuum or may be stepped downwardly outwardly or otherwise shaped to meet the inflow or outflow requirements to be met for any particular installation. The top edge of the back wall, the top and outer edges of the sidewalls, and the outer edge of the tray are each preferably provided with margins that provide a degree of rigidity to the integral structure and additionally serve to stabilize earth or fill in the immediate vicinity of the headwall. The aforementioned elements are preferably prefabricated as a single integral structural unit.

The sidewalls may be generally planar or may be curved, in the manner described below. Equally, the upper edges and associated margins of the sidewalls may be generally rectilinear, but may instead be generally convex. The use of curved surfaces tends to strengthen the resulting structure.

In headwalls according to the invention, the thickness of the laminate can be varied and the type or quantity of composite reinforcement can be varied so as to vary the overall physical properties of the structure. Suitable adjustment of mass and quantity and type of reinforcement can accommodate the varying structural requirements of headwalls of varying sizes. In contrast with conventional precast concrete designs, the required structural rigidity of headwalls according to the invention is provided primarily by form and bracing rather than by thickness and weight.

To provide walls of a given strength, composite laminates can be formed as relatively thin, lightweight panel sections whose outermost edges may continue as flanged margins for both rigidity and earth retention. A problem with such relatively thin-walled material, however, is that the walls can easily flex under load, and a headwall made of such material will lack inherent mass and thus be susceptible to shifting once installed in an earth bank or the like. According to an aspect of the invention, at least the lower outer portions of the sidewalls are sculpted to provide both structural reinforcement and stabilizing cavities or recesses into which earth or fill enters upon installation to help stabilize the structure. In one embodiment of the invention, the sidewalls comprise wing panels diverging from one another, the rear vertical edges of the wings being common with the vertical side edges of the backwall, and reinforcing panels interconnecting the wings to outer side portions of the tray and to the lower side margins of the sidewalls. The reinforcing panels are at an oblique angle to both the wings and to the tray so as to provide a buttressing reinforcement for the wings. The back wall, tray, sidewalls (including both wings and reinforcing panels) and margins form a single continuous surface defining the flow channel for constraining the water flow.

Reinforcing panels designed as aforesaid perforce provide cavities or recesses at the outsides of the lower outer portions of the sidewalls, permitting earth or fill to enter into and bear against the outer surfaces of the reinforcing panels defining these recesses, thereby helping to stabilize the structure in the earth bank or the like in which it is installed. Such stabilization function is enhanced if the recesses are partially closed off in the outer portion thereof by front reinforcing panels lying in a plane that will be close to parallel to the slope of the earth or fill in the vicinity and also close to perpendicular to the water flow. These front reinforcing panels tend to prevent or impede earth or fill from moving outwards in the vicinity of the lower side edges of the sidewalls, as well as providing stiffness and buttressing reinforcement for the adjoining portions of the sidewalls. If desired, backfill may partly cover the outer front surfaces of the front reinforcing panels to help anchor the structure. For use in entrance mode, the front reinforcing panels are preferably inwardly inclined so as to direct water into the entrance channel of the headwall structure.

Alternatively, as much of the foregoing structure as wished may be formed as a curved continuum. Instead of discrete planar panels, albeit integrally formed together as a single unit, the wings, top brace above the back wall, reinforcing panels, and even at least the side portions of the back wall itself, may be integrally formed as a curved continuum. In such curved continuum embodiment, the lower outer edges of the sidewalls should be reverse-curved to provide convex surfaces relative to the interior flow channel space defined by the sidewalls and the tray, for preferred flow channel definition and so as to stiffen and buttress the upper portion of the sidewalls. These convex surfaces are of course concave on the outside surfaces of the sidewalls and form recesses or cavities engaged by the adjacent soil bank. As in the case of the planar panel embodiment earlier described, the lower outer portions of the reverse-curved surfaces should include a substantial front surface area that lies generally parallel to the slope of the adjacent earth bank so as to define with the remaining concave surfaces of the reverse-curved portions of the sidewalls a substantial recess or cavity that receives a substantial amount of earth or fill and thus helps to stabilize the headwall structure in place, and which front surface area can be partially covered by backfill if desired.

Hybrids of the foregoing designs are possible; for example the back wall and tray may be generally planar, the sidewall wings curved, the reinforcing panels either planar or curved but not following the curvature of the wings.

In this description, terms such as "vertical" and "outward" are relative and apply to the installed headwall. Further, as the overall orientation of any given headwall as installed will be variable, and as the demands of any particular culvert outlet (say) will be variable, some latitude is to be given such terms. For example, if the headwall is located at the top of a sloped land area, it may be desired that the tray, serving as an outlet tray, also be designed to be downwardly outwardly sloped so as to merge with the land, rather than having a strictly horizontal orientation, or its margin extended as an apron to impede erosion of the earth bank thereunder. Note also that as a given headwall may be installed either upstream or downstream of a culvert (say) for use either as an exit structure or an entrance structure, the terms "upstream" and "downstream", "outflow", and the like, are inherently relative. For convenience of description, an exit mode of use of the headwall is frequently presumed in this specification unless otherwise specified; a term such as "outlet tray" used to describe an element of the headwall is used in such relative sense. Clearly if the headwall were reversed in orientation for use in entrance mode immediately upstream of a culvert inlet, the tray of the headwall structure would in fact serve as an inlet tray. The term "longitudinal" herein refers to the general direction of water flow and is coincident with the axis of the pipe stub or spigot to be described below.

The sidewall structure preferably comprises a pair of side brace panels, one for each said sidewall. Each side brace panel may conveniently extend obliquely between (and relative to) both the associated sidewall wing and a respective side portion of the tray. Each side brace panel is fixed along an upper edge to the associated sidewall wing and along a lower edge to the tray. The side brace panel may be formed integrally with and as an angled continuum of the associated sidewall wing, and likewise may form a continuum with the tray. For surface continuity, earth bank stabilization and further reinforcement of the sidewall structure, a pair of generally triangular front brace panels join the outer edges of the side brace panels to the outward portion of the tray and to the front side margins. The outer bottom edge of each front brace panel may stop short of the outer edge of the tray and may be angled inwardly so that if the headwall is installed for entrance use (so that the tray becomes an inlet tray), water will be directed inwardly for channeling into the entrance channel. The combined exposed surfaces of the brace elements and the tray serve to define chute (flow channel) surfaces for either incoming or effluent water, depending upon the installation, in either case providing a preferred flow channel shape for the water flow. The brace elements further provide buttressing of the wings. The brace elements further define the cavity or recess earlier described at the outer lower side edges of the sidewalls for receiving earth or fill to help stabilize the structure.

Where the curved continuum embodiment of the invention or a hybrid embodiment is designed and used, the front brace panels may be planar and the side brace panels curved, or both sets of panels may be curved, or there may be no discrete side or brace panels, but simply a continuous curved surface, the outer lower portion of which is reverse-curved as previously described to provide a convex inside surface for preferred chute configuration and a concave outside surface for stabilizing the structure in the earth bank or the like.

All of the constituent walls of this structure may conveniently be of substantially uniform cross-section whereby the front and rear surfaces of the headwall structure are substantially identical. The flanged margins optionally but preferably provided along the back wall and sidewalls of the structure and formed at a substantial angle to the adjoining walls further reinforce the structure and facilitate stabilization of the adjacent earth bank.

Note that headwall structural units as described may be configured to nest and stack, and therefore can be economically shipped in large quantities.

Advantageously, for connection to a pipe, the headwall is provided with a spigot mating with the pipe or with a range of possible pipe connections. It is advantageous that the spigot be designed for maximum adaptability. To this end, the spigot may be formed to be substantially dimensionally identical to a section of a standard pipe so that a connector for such pipe will fit the spigot without the requirement of any special adapter. Thus a given manufacturer's pipe section can be connected to the headwall structure as desired. The prefabrication permits the spigot to be designed to mate with the pipe connection system of any given pipe manufacturer.

To build a spigot that conforms to a given pipe connection system, the headwall manufacturer may advantageously use an actual pipe section having a terminal end portion structured in conformity with a given manufacturer's specifications, and may, using an appropriate mold, replicate this end portion exactly on the spigot, thereby to generate a spigot of a particular size and form that can be interconnected with a mating pipe section by using the manufacturer's double female coupling element. To this end, a section of the terminating portion of the actual pipe is inserted into a hollow container from which a female mold is prepared. The spigot mold can then be integrated with other mold portions to form part of the overall mold for the headwall, and is used to generate a spigot inherently configured in exactly the same pipe-end configuration as the mating pipe to which the spigot is designed to be coupled. Such spigot design facilitates a bond generally free of leaks, a smooth confluence of interior surfaces, and without loss of cross-sectional area within the headwall. Such design also facilitates and expedites installation.

Some but not all of the advantages of the above-described embodiments of the invention can be obtained by manufacturing the headwall structure as a set of discrete substructures that are finally assembled together on site. For example, the tray and associated margin could be one substructure, each of the sidewalls with margins another substructure, and the back wall, top cross-piece margin and spigot a further substructure. These substructures could be provided with fasteners for mechanical interconnection, or could be bonded together by laminating or adhesive bonding or the like. This manufacturing approach may be desirable where the fully assembled headwall structure is very large or very heavy.

Further, since the manufacturer of headwalls according to the invention will probably wish to provide headwalls having differently configured spigots that match terminating ends of various pipe connection systems, it is advantageous to manufacture the spigot units as discrete components, each having a standard interface for mating with another component of the complete headwall structure. The manufacture and sale of headwalls as such two-component structures can help reduce the size and weight of the manufacturer's inventory. In such two-component headwall structures, one component is the spigot that is molded integrally with an immediately adjoining flanged wall structure (open, of course, with the same interior opening as the spigot itself). The other component, comprising the main body portion of the headwall, is provided with a mating aperture in its back wall for receiving the flanged wall of the spigot portion in a mating engagement. The interface between the spigot component and the body component is accordingly standard, so that a number of different spigot components for connection to a number of different standard pipes could be available in manufacturer's inventory, each mating with the body portion of the headwall by reason of the mating of the outer periphery of the spigot flange with the aperture of the body portion of the headwall. A square interface is preferred for ease of manufacture and because one need not be concerned about the orientation of the spigot component when fitting it to the aperture in the body portion of the headwall.

The spigot component can be both chemically bonded and mechanically fastened within the aperture of the body component using any glues and fasteners desired (e.g., plastics bonding glue, screws or various nut-and-bolt arrangements, or attachment brackets) once the outer surfaces of both components are flush.

This two-component design permits the manufacturer to have available in inventory a relatively small number of precast body portion components and few if any spigot components; the manufacturer may cast spigot components on demand as orders come in. The total volume and weight of the manufacturer's inventory can thus be appreciably reduced. Further, the shipping weight of each component and the size of each component is lower than if the two were combined into an integral unit, and handling each individual component is facilitated. A disadvantage of these two-component headwall structures is that fasteners and an assembly operation are required, presumably on site, to couple the two components of the headwall together. This disadvantage, however, is expected for most installations to be more than offset by the aforementioned advantages.

Headwall structures made according to the invention are relatively environmentally safe, because the structures can be made of materials not subjected to serious erosion or leaching, and may be suitably coated to this end. All materials used to fabricate these structures can be selected to be chemically resistant to acids and alkalis, including road salts and wood preservatives. Such inert materials are not conducive to bacterial growth.

The gross weight of a headwall structure according to the invention can be as little as 10 to 15 percent of the weight of a conventional precast concrete structure suitable for use in the same location. It can be readily seen that the use of headwall structures according to the invention can substantially reduce the cost of labour, handling, shipping, and lifting equipment for installation of such structures as compared with the cost of conventional structures.

DETAILED DESCRIPTION OF THE PREFERRED EMBODIMENTS

Figure 1:
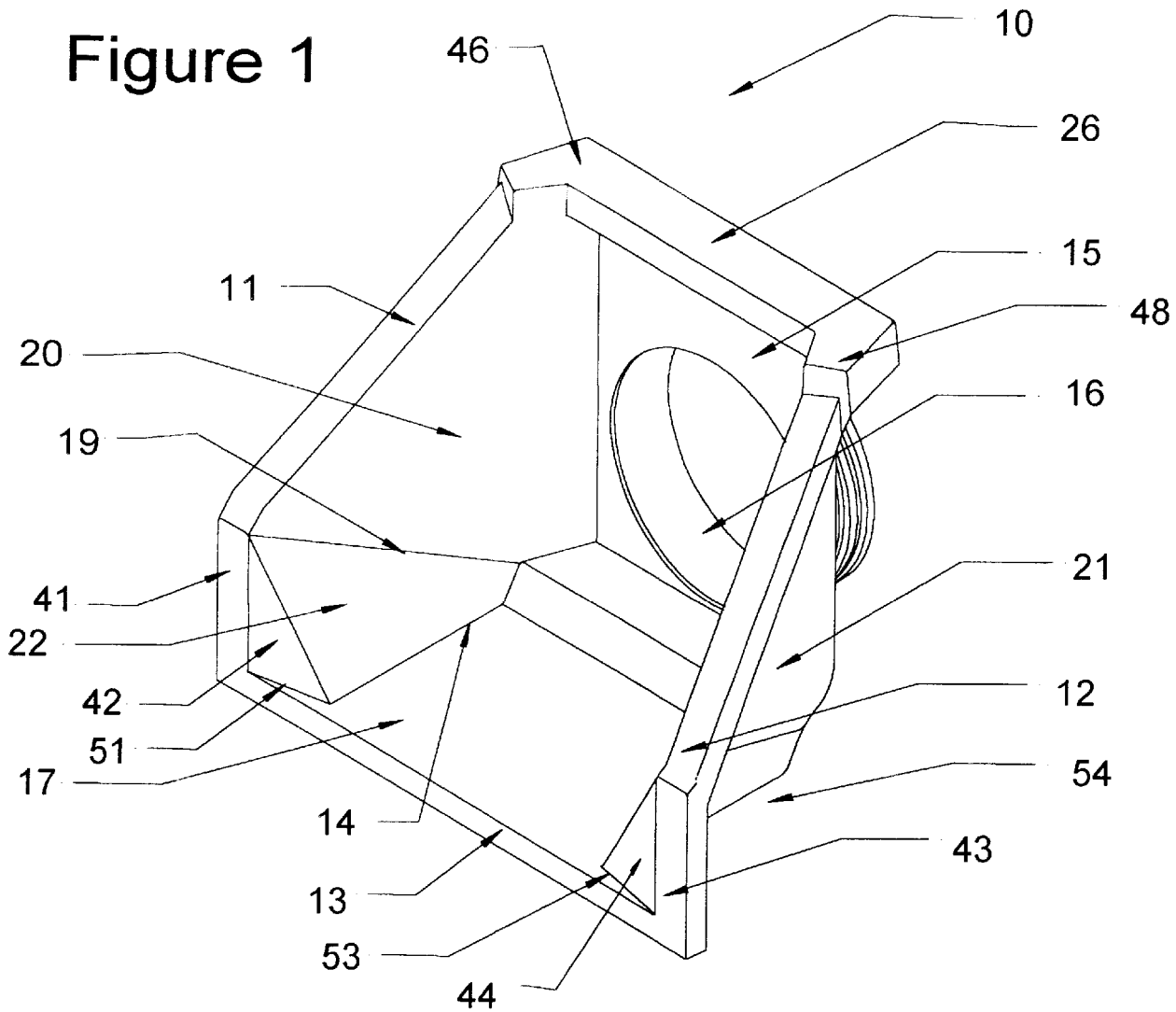
FIG. 1 is a schematic isometric view of a first embodiment of a headwall according to the invention, in which the inside wall surfaces of the sidewalls are generally planar and all edges generally rectilinear.
Figure 2:
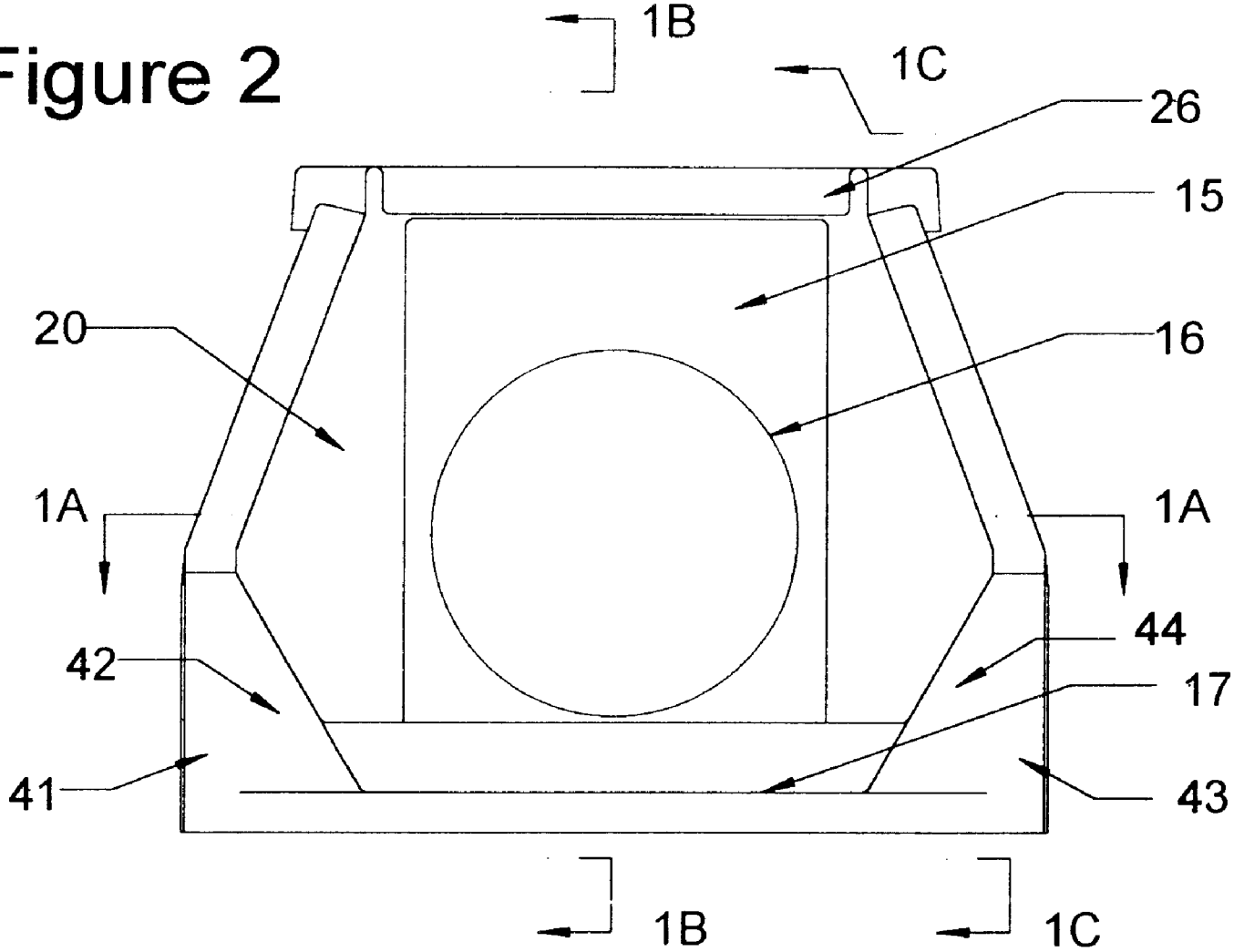
FIG. 2 is a schematic front elevation view of the embodiment shown in FIG. 1.
Figure 3:
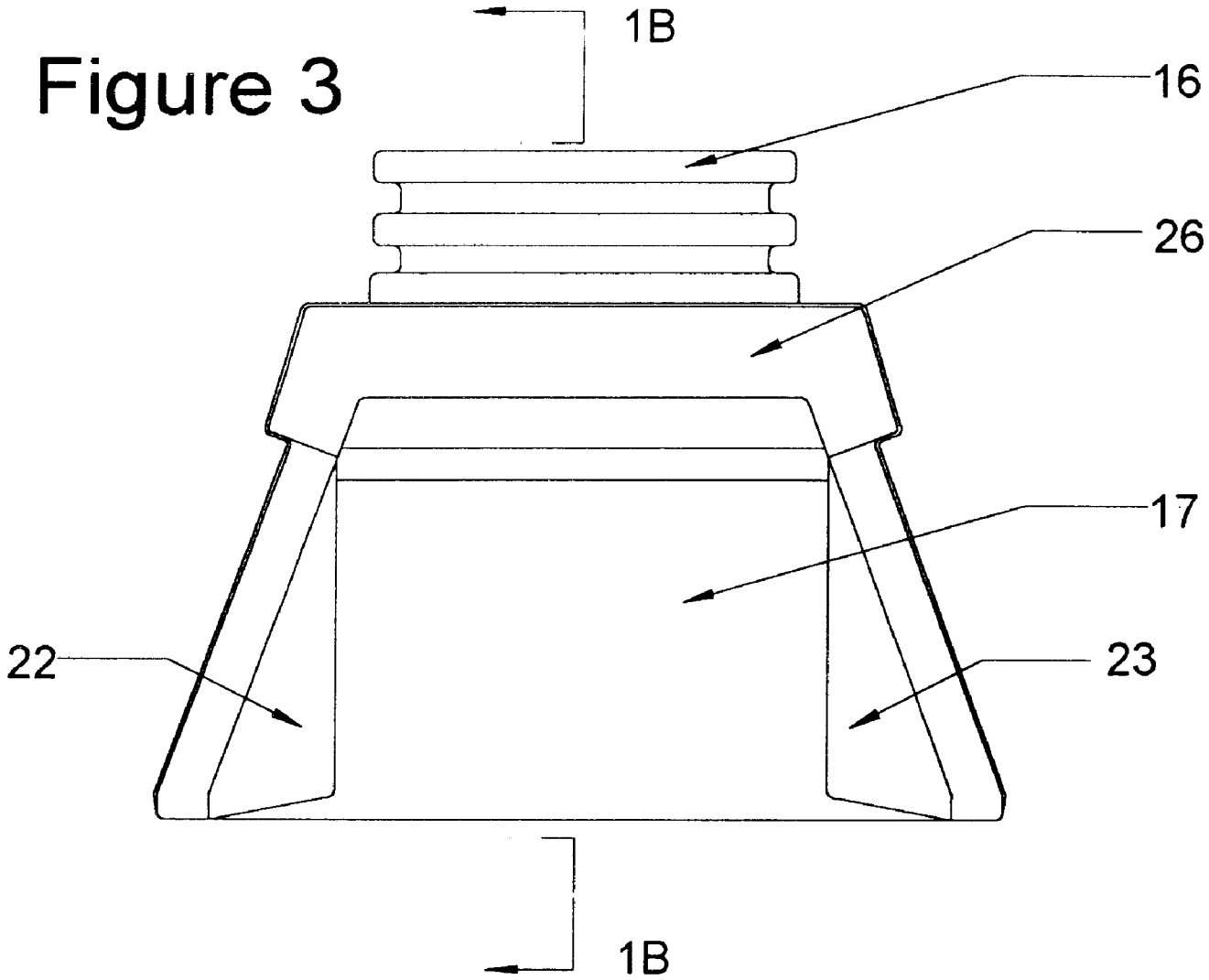
FIG. 3 is a schematic plan view of the headwall shown in FIG. 1.

Referring to FIGS. 1–7, it will be seen that the headwall structure generally indicated as 10 consists of a number of component elements all of which are molded from a lightweight reinforced composite. For manufacturing convenience, aesthetics, and design balance, the overall design of this embodiment of the invention is symmetrical about a vertical center plane (the plane defined by section line 1B—1B of FIG. 3). The structure 10 is designed to be prefabricated as an integral unit, so constituent surfaces and angles are chosen accordingly to permit ready release from the mold, and also to facilitate nesting and stacking for transport and storage. When manufactured as an integral unit, the headwall 10 is only conceptually made of component elements; these component elements merge together and their surfaces form a single uninterrupted surface. However, it is useful to think of the integral structure 10 as formed of component elements, for convenience of description.

Suitable composites of which the headwall may be manufactured are previously known and consist of various resins loaded with suitable fibers, especially glass fibers, and other solids. The resins of choice are not limited to thermosetting resins, but may be thermoplastic. Where additional mass is desired for stabilizing the headwall structure or the adjacent earth mass when the headwall is installed, some of the constituent wall portions of the headwall may be provided with cores made of suitable polymer concrete core material, also previously known per se. While the structure herein described is preferably prefabricated as an integral unit, selected portions of the structure may instead be mechanically fixed or adhesively bonded to previously formed substructure; in some circumstances, depending upon site requirements, some portions may be left to be bonded or otherwise attached to a partially installed substructure at the work site. Manufacture of the structure 10 as a number of discrete substructures and subsequent assembly of these substructures on site may be desirable where the overall structure 10 is very large or very heavy as compared with integral headwall structures according to the invention.

After fabrication, the headwall 10 may be post-cured to facilitate as much cross-linking as possible of the resin, thereby tending to minimize future leaching, and optimizing physical properties. In accordance with industry-accepted practice, the entire surface of the headwall 10 prior to installation may be covered with a gel coat that may optionally be granite-impregnated to improve resistance to erosion, moisture damage, and wear. Preferably the gel coat should be selected to conform to water potability standards. Both the outer surface of the composite laminate of the exposed headwall surfaces and the gelcoat should have a rough or non-reflective finish to reduce glare if such surfaces will reflect vehicle headlights.

The headwall 10 has a back wall 15 provided with an integrally formed pipe connection stub or spigot 16 surrounding a generally central orifice comprising the outlet end of a water conduit. The spigot dimensions and configuration may be of several different standard selections each corresponding to the terminal end of a standard drainpipe supplied by any one of several different manufacturers. This design feature permits ready coupling of the spigot 16 to a selected drainpipe, using couplings or connectors of a design typically provided by the pipe manufacturer to couple together abutting pipe sections.

Extending outwards from the base of the back wall 15 is a tray 17 that may be planar but is preferably stepped as illustrated in FIG. 1 both for strength and rigidity of the integral headwall structure, and also to provide a shallow waterfall immediately downstream of the spigot 15, thereby facilitating outflow of small-size debris, when the tray is used in exit mode. Where there are fish in a stream served by the headwall 10, the step also may serve to define in part a turbulation pond that facilitates fish migration. As will be seen in FIG. 4, the tray is manufactured to include a core 18 that may be incorporated into the tray during the fabrication process and is preferably made of polymer concrete.

A pair of outwardly diverging or flared sidewall wings 20 and 21 join the back wall 15 and the upstream step of the tray 17. In this embodiment the wings 20, 21 are planar and together with the back wall 15 and the tray 17 define and partially enclose a space approximating that occupied by a truncated right rectangular prism of generally corresponding dimensions. Configurations of this general sort are per se known in the design of concrete headwalls. Along the lower inclined edges of the wings, side brace panels 22, 23 are formed that extend downwards and inwards to join the side edges of the tray 17. These brace panels 22, 23 partly define side recesses generally indicated by the reference numeral 54 on each side of the structure 10, the right-hand one of which (as seen in FIG. 1) is visible in the illustrations. The recesses are further defined by generally triangular planar front brace panels 42, 44 that extend between the forward edges of the side brace panels 22, 23 and the tray 17.

For improved structural rigidity and especially to provide soil or fill stabilization in the immediate vicinity of the headwall 10 when installed, the top, bottom and side edges of the structure are continued as marginal flanges. These marginal flanges include a top flanged crosspiece 26, sloped side flanges 11 and 12, front flanges 41 and 43, and bottom flange 13, each formed integrally with the adjoining structure to be described in detail below.

In many installations, the top flange or cross-piece 26 may be expected to have to withstand fairly heavy stresses and impact, since it may have to absorb traffic loads; further, stones and debris from above may strike it, so for such reasons the top flange 26 may be formed with a relatively thick wall if desired. Further, the top flange 26 is preferably provided with end corner reinforcements in the form of stepped corner extensions 46, 48 that interconnect the top flange 26 with the top portions respectively of sloped side flanges 11 and 12 and also serve to maintain the structural integrity and rigidity of the rear (inward) upper portions of the associated sidewall wings 20, 21. Because the flanged crosspiece 26 also should resist overshoot of material from above the headwall 10, it may be designed as an oversize element.

All of the flanged elements may, if desired, be formed with incorporated polymer concrete cores, as will be described further below. Any of the flanges may be extended or attached to aprons or the like (preferably formed integrally therewith); such extension or apron may be especially desirable for the bottom flange 13, depending upon soil slope and conditions immediately downstream of the tray 17 used in outflow mode, for the purpose of impeding soil erosion underneath the tray 17. Further, the outer edge of the tray 17 and associated bottom flange 13 may be centrally inwardly recessed if desired for improved rigidity and to further define the water flow exit channel (when tray 17 is used in exit mode).

It is intended that the headwall 10 be lightweight for ease of transportation and handling during installation. Accordingly, the wall thicknesses of component walls of the headwall 10 should be as thin as possible consistent with adequate strength and rigidity to meet the earth stabilization demands of the installation site. Especially, the outer portions of sidewall wings 20, 21 would in the absence of reinforcement be prone to excessive flexure and deformation in response to soil pressure from the adjacent earth or fill bank. To provide such reinforcement, the essentially identical side brace panels 22 and 23 are present, side brace panel 23 being the mirror image of side brace panel 22 and its joinder with the associated structure also mirroring that of panel 22. Side brace panel 22 extends from an oblique upper edge 19 constituting the lower edge of the associated sidewall wing 20 to a lower edge 14 lying along the tray 15. The corresponding mirror-image side brace panel 23 is similarly joined to its associated sidewall wing 21 and to the tray 15. The side brace panels 22, 23 perform a multiple function in providing reinforcement to the sides of the structure, in defining a portion of the stabilizing recess 54, and in defining in part the water outflow channel.

The side brace panels 22, 23 merge respectively into the generally triangular front (outer) brace panels 42, 44 that are also mirror images of one another. The combination of a given side brace panel, say 22, with its associated front brace panel 42, constitutes a strong buttressing reinforcement of the associated sidewall wing 20 of the headwall 10 and adds desirable rigidity to the overall structure so that the adjacent earth or fill is more reliably stabilized than would be the case if the sidewall wing 20 were readily able to flex relative to the rest of the structure of headwall 10. It can be seen that each front brace panel 42, 44 joins the outer edges of the respectively associated side brace panel 22, 23 to an associated outward portion of the tray 17 and to the associated front marginal flange 41, 43 respectively. The lower edges 51, 53 of the front brace panels 42, 44 are inwardly angled so that they are inset from the bottom flange 13. The inward inclination of the front brace panels 42, 44 facilitates flow of water inwardly into the flow channel when the headwall 10 is used in entrance mode, thereby impeding erosion of the underlying earth or fill.

The recesses 54 are filled with adjoining earth or fill when the headwall 10 is installed, thereby facilitating stabilization of the structure 10. When backfill is applied to the headwall 10 once it is installed in place, some of the backfill can overlap the front brace panels 42, 44 to further stabilize the headwall structure 10 in place. The particular angles and dimensions chosen for the bracing elements 42, 44, 22 and 23 may be selected to meet particular side slope and ditch contour conditions at the work site at which the headwall structure is to be installed. Further, since the bracing elements 42, 44, 22 and 23 define the water flow channel, their configuration and angulation should be selected with optimal flow characteristics in mind.

While the structure illustrated, to reinforce the sidewalls, comprises at each side a side brace panel and a front brace panel, thereby comprising an interjoined two-panel bracing structure, it will be readily apparent that instead of only two such interjoined panels, three or more bracing panels could be used instead. Such panels should meet at outside obtuse angles to one another for effective water flow channeling, effective bracing, and effective definition of the stabilizing recesses 54. Of course, on the inside surfaces of the interconnected panels, the angles at which the panels meet would typically exceed 180°.

Figure 4:
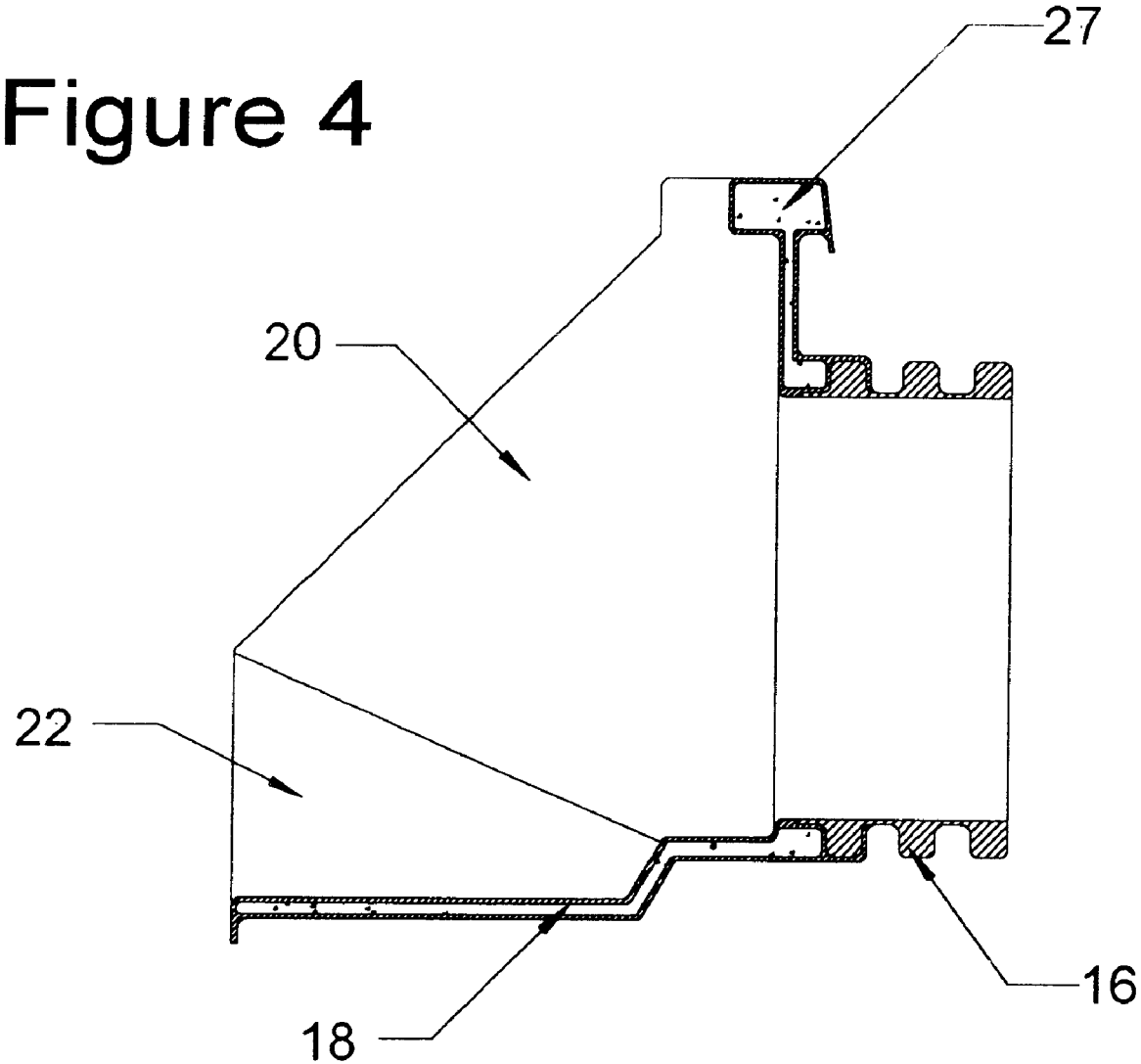
FIG. 4 is a schematic side elevation section view of the headwall shown in FIG. 1 taken along section line 1B—1B of FIG. 2.
Figure 5:
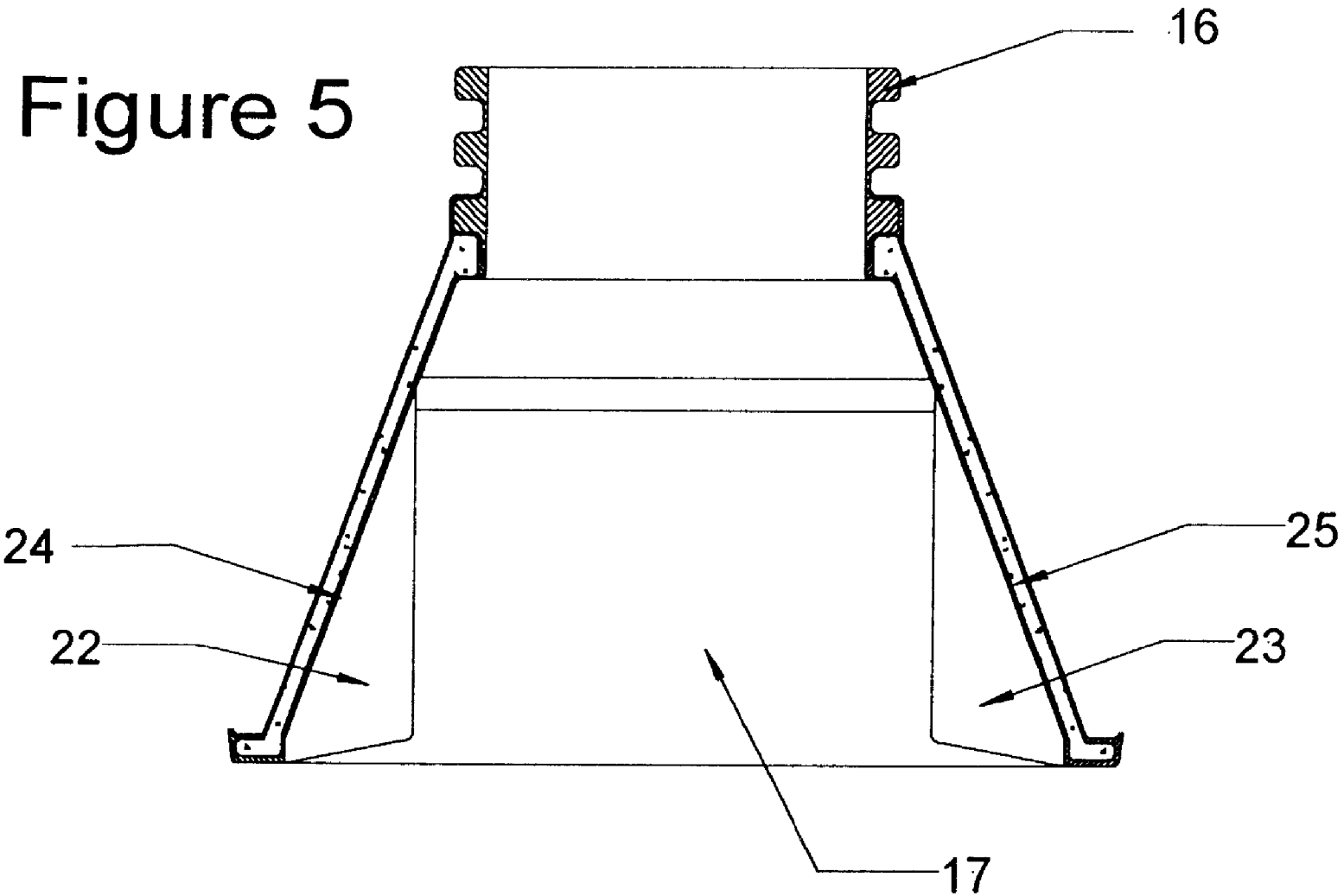
FIG. 5 is a schematic plan section view of the headwall shown in FIG. 1 taken along section line 1A—1A of FIG. 2.
Figure 6:
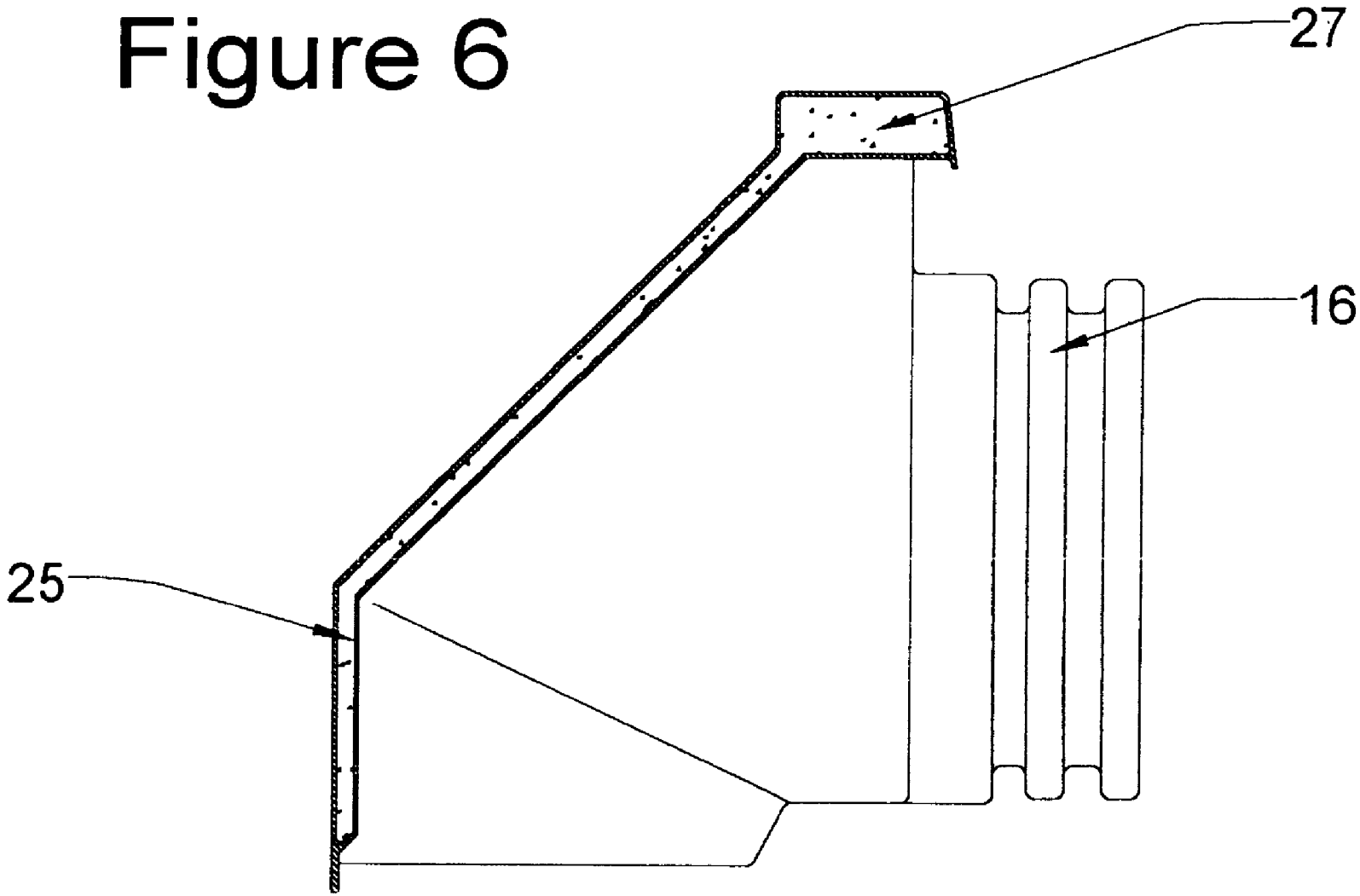
FIG. 6 is a schematic side elevation section view of the headwall shown in FIG. 1 taken along section line 1C—1C of FIG. 2.
Figure 7:
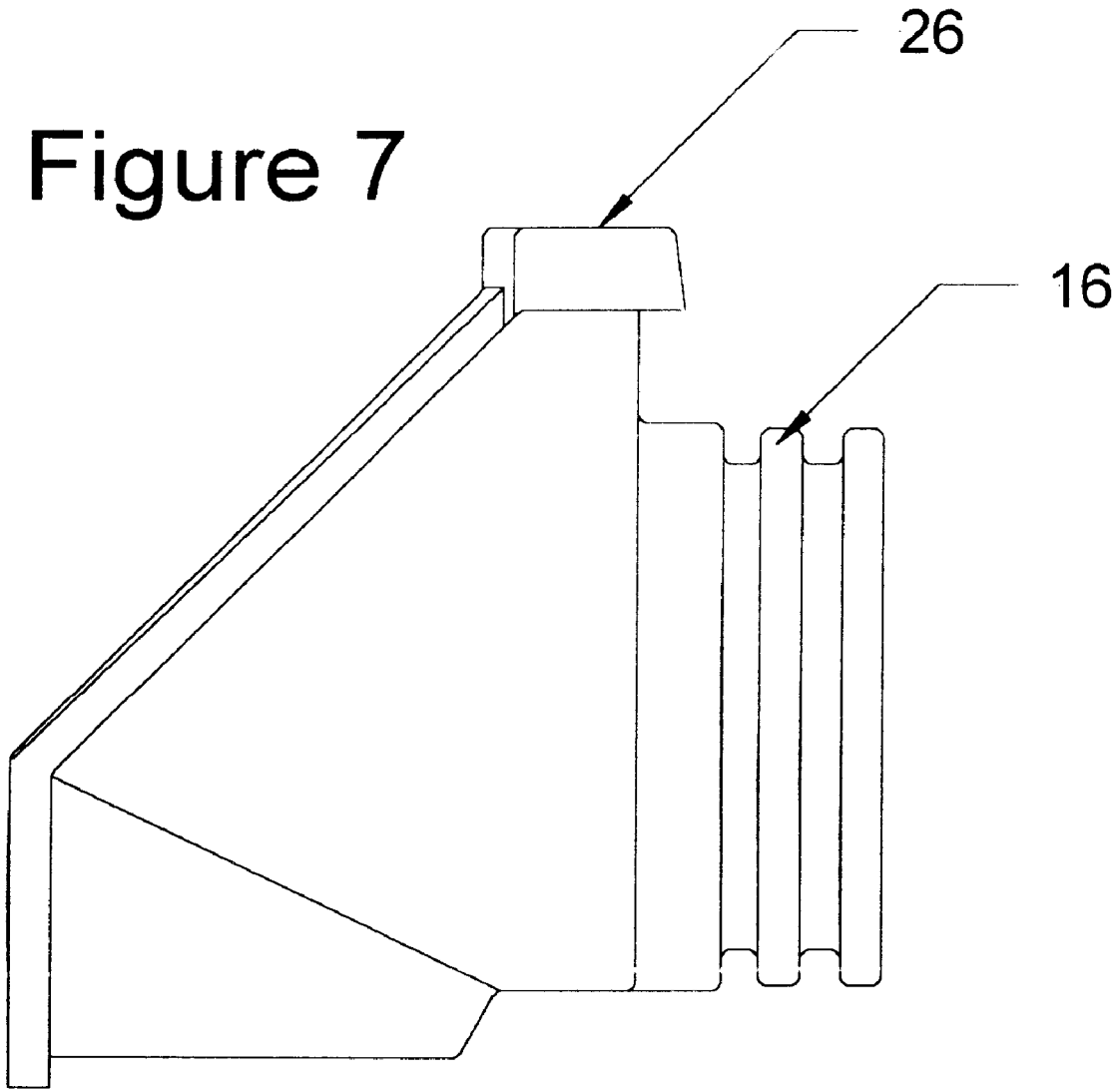
FIG. 7 is a schematic side elevation view of the headwall shown in FIG. 1.

As will be seen in FIGS. 4, 5 and 6, the tray 17, the sidewall wings 20, 21, the brace panels 22, 23, 42, 43, the associated marginal flanges 11, 12, 13, 41, 43, and the top flange 26 with its associated corner reinforcement portions 46, 48, all may incorporate polymer concrete cores. Cores 24 and 25 are illustrated for the sidewalls 20, 21; core 27 for the top flange 26 with its associated corner reinforcement portions 46, 48, and core 18 for the tray 17. The cores 27 and 18 are shown as extending all the way to the outer limit of the spigot 16 (FIG. 4) to provide collar reinforcement for the spigot 16 where it joins the back wall 15. Cores may be provided to add mass and rigidity; they may be selectively provided where a higher modulus of elasticity of the structure is required. Polymer concretes are known; they typically include binders comprising selected resins carrying aggregates, sand, microspheres, glass fibers or organic fillers, and the resin used should preferably be matched to the resin used for the composite overlay for optimum bond between cores and composite laminate layers. It can be readily perceived that the cores may constitute a skeleton or framework to the extent required to provide or supplement support and rigidity to the overlying composite laminate.

It can be seen from the foregoing description that all of the parts of the headwall structure can be fabricated as a single unitary integral piece that incorporates cores as and where required. When installed at a work site, such integral structure is able to withstand the forces from the adjacent soil bank and yet is sufficiently flexible to accommodate settling of the bank and backfill. The polymer concrete cores add mass, strength and rigidity with minimal additional weight; even with the cores included, the headwall structure according to the invention can weigh a small fraction—perhaps as little as ⅙—of the weight of a concrete structure designed to meet the same requirements.

The angles chosen for the surface slopes and common edges of the sidewalls including associated brace panels are preselected to retain side banks and slopes of various properties in various types of terrain. The headwall structures 10 can accordingly be manufactured in various standard sizes and configurations to meet a range of expected conditions and requirements, or may be individually designed as required. Note that the choice of frontal area of the front brace panels 42, 44 is particularly important as these panels 42, 44 lend stability to the installed unit, because once the headwall 10 is in place, bank slope backfill overlaps the front brace panels 42, 44, thereby anchoring the headwall 10 in place. In addition, the shaping especially of the side brace panels 22, 23 can be selected to assist in funnelling the water flow, minimizing turbulence by cooperating with the sidewall wings 20 and 21 to provide a gradual tapering of flow cross-section.

Figure 8:
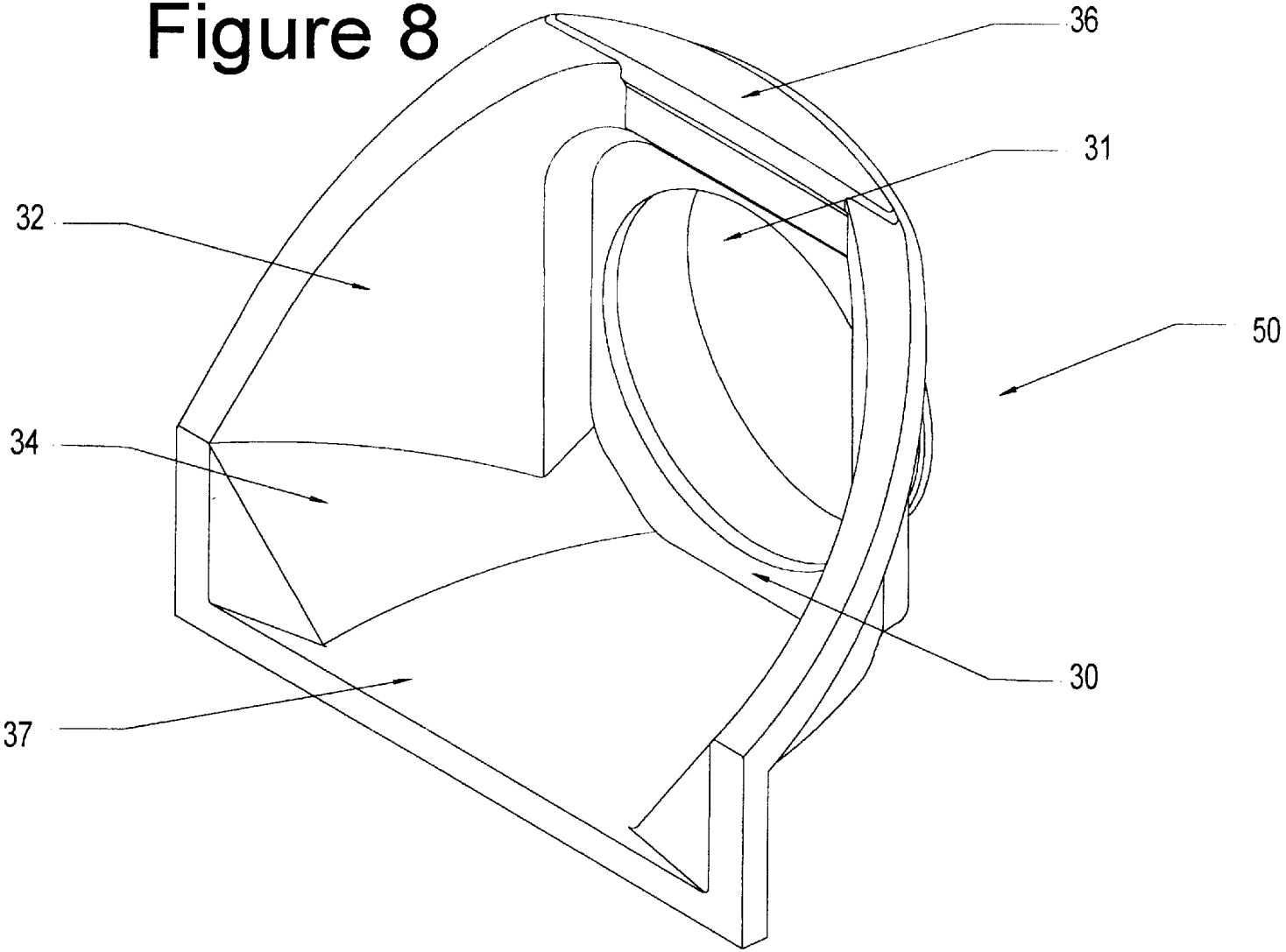
FIG. 8 is a schematic isometric view of a second embodiment of a headwall according to the invention, in which the inside wall surfaces of the sidewalls are generally concave and the top edges of the sidewalls are generally arcuate.
Figure 9:
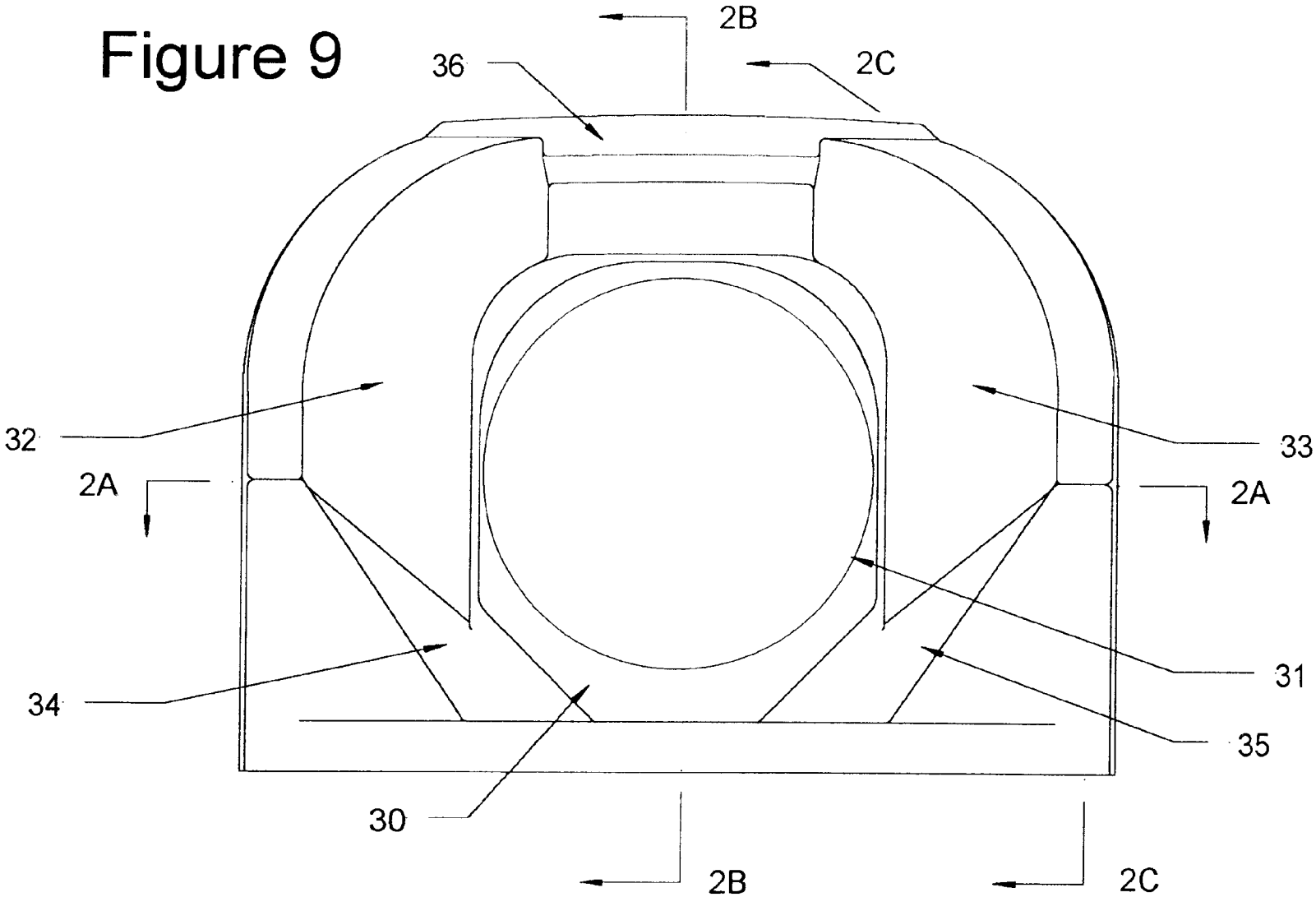
FIG. 9 is a schematic front elevation view of the headwall shown in FIG. 8.
Figure 10:
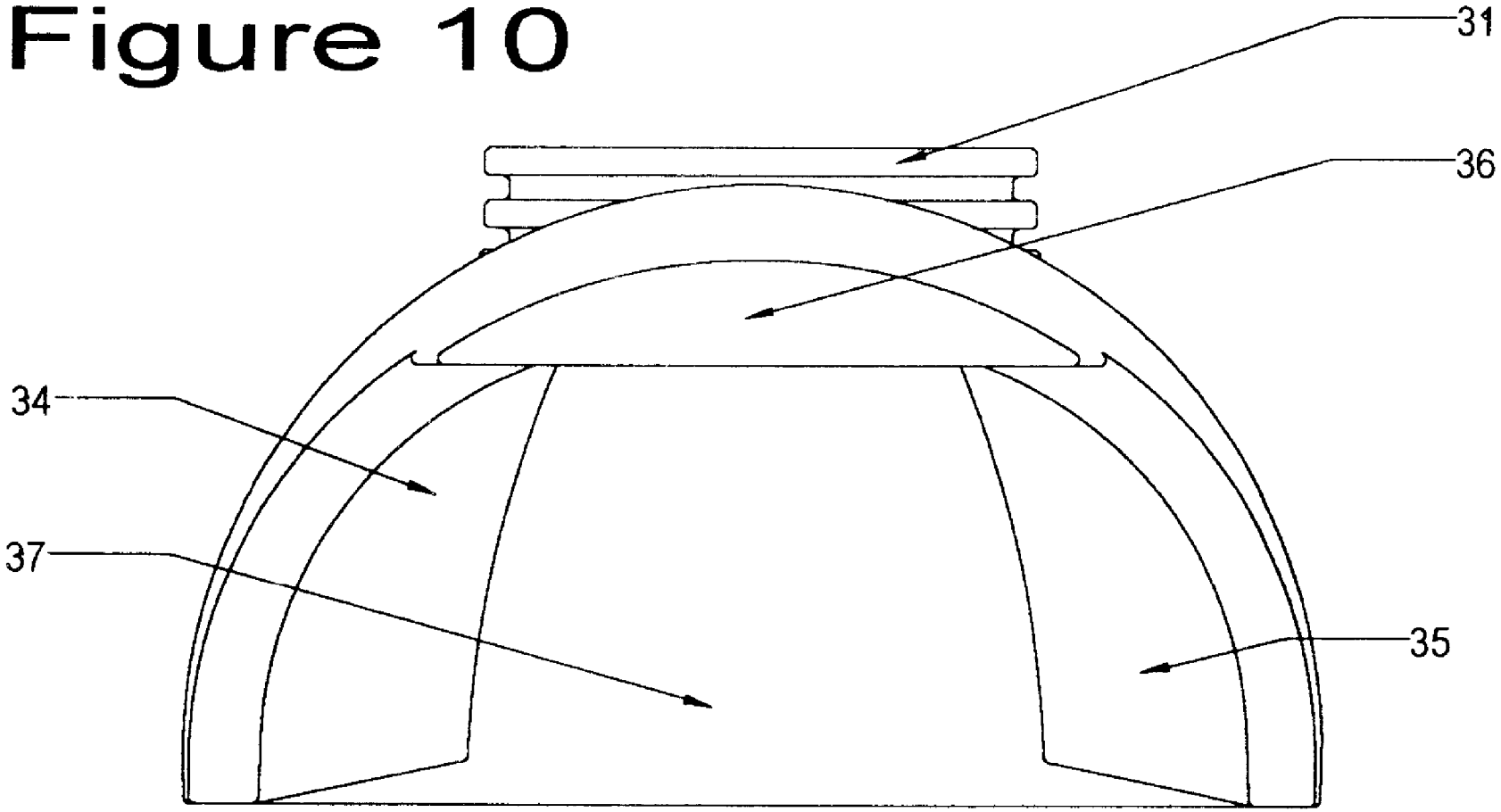
FIG. 10 is a schematic plan view of the headwall shown in FIG. 8.
Figure 11:
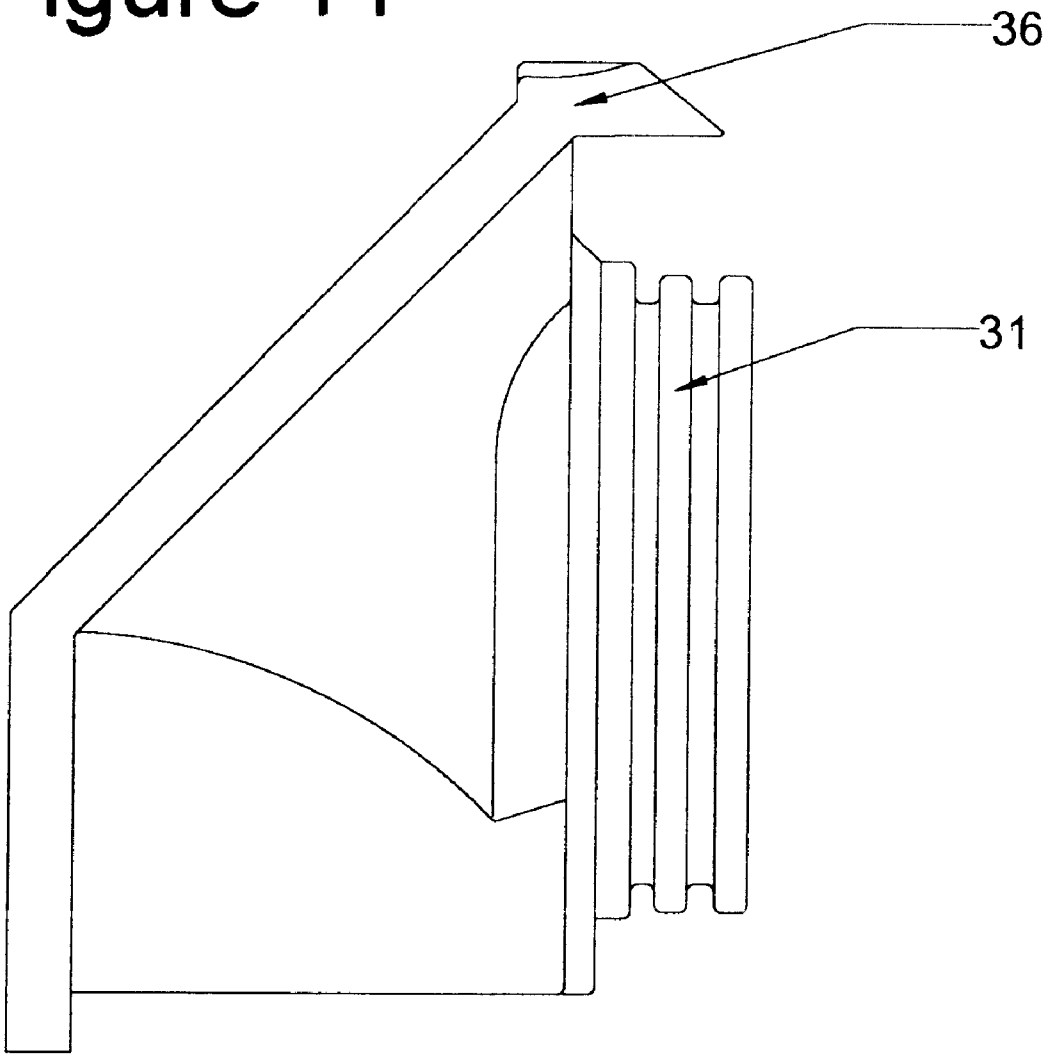
FIG. 11 is a schematic side elevation view of the headwall shown in FIG. 8.
Figure 12:
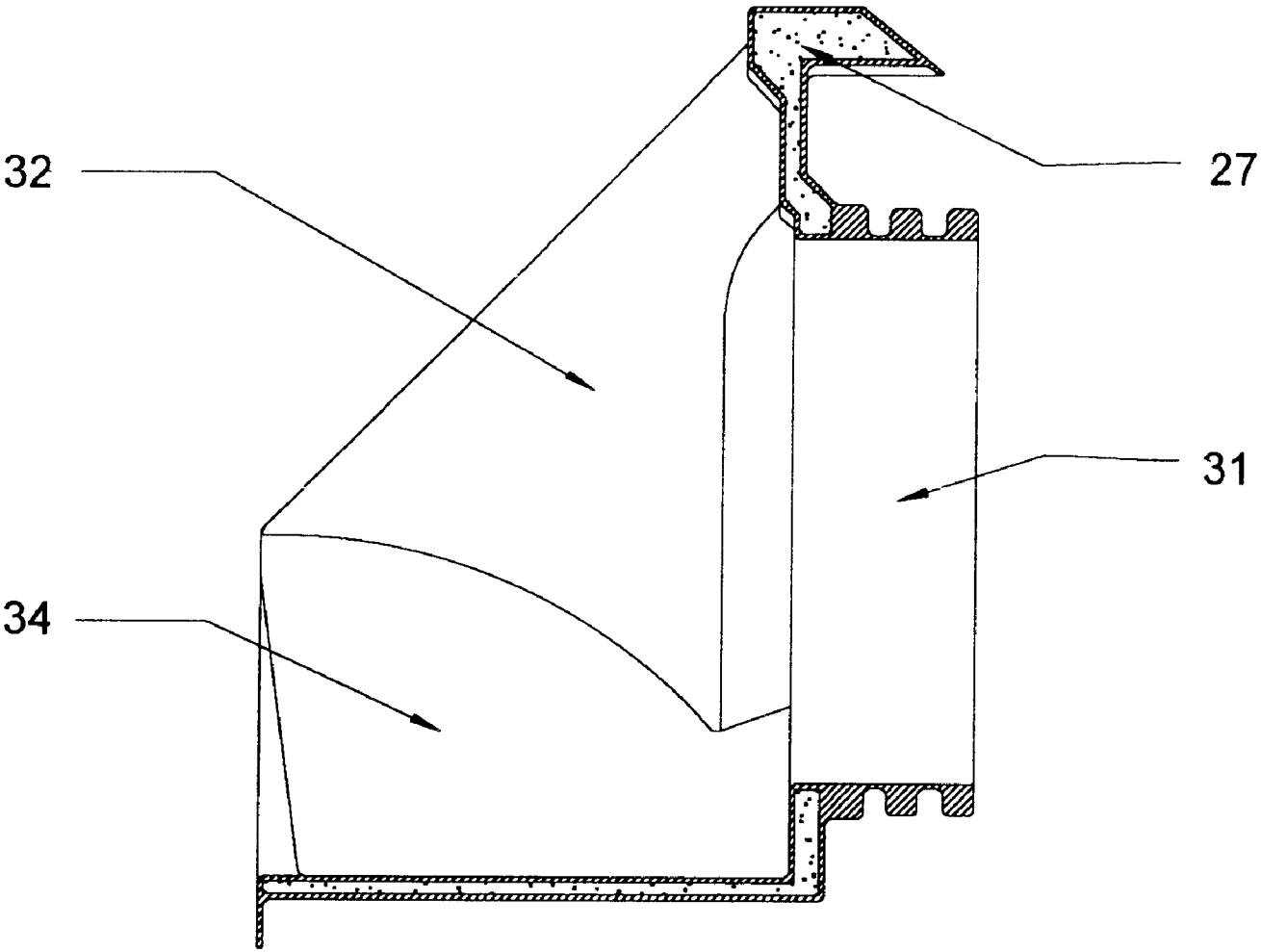
FIG. 12 is a schematic side elevation section view of the headwall shown in FIG. 8 taken along the section line 2B—2B of FIG. 9.
Figure 13:
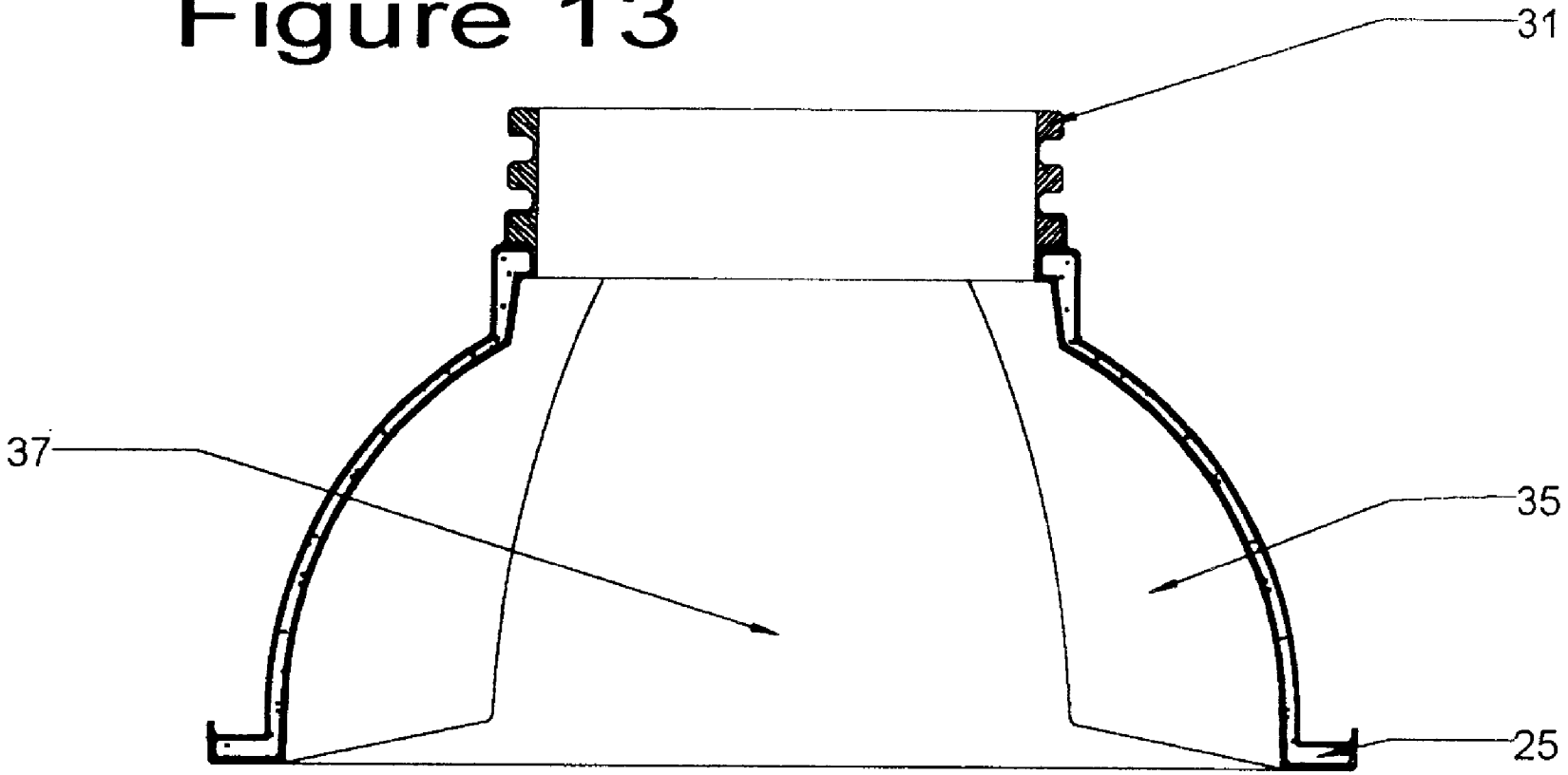
FIG. 13 is a schematic plan section view of the headwall shown in FIG. 8 taken along section line 2A—2A of FIG. 9.
Figure 14:
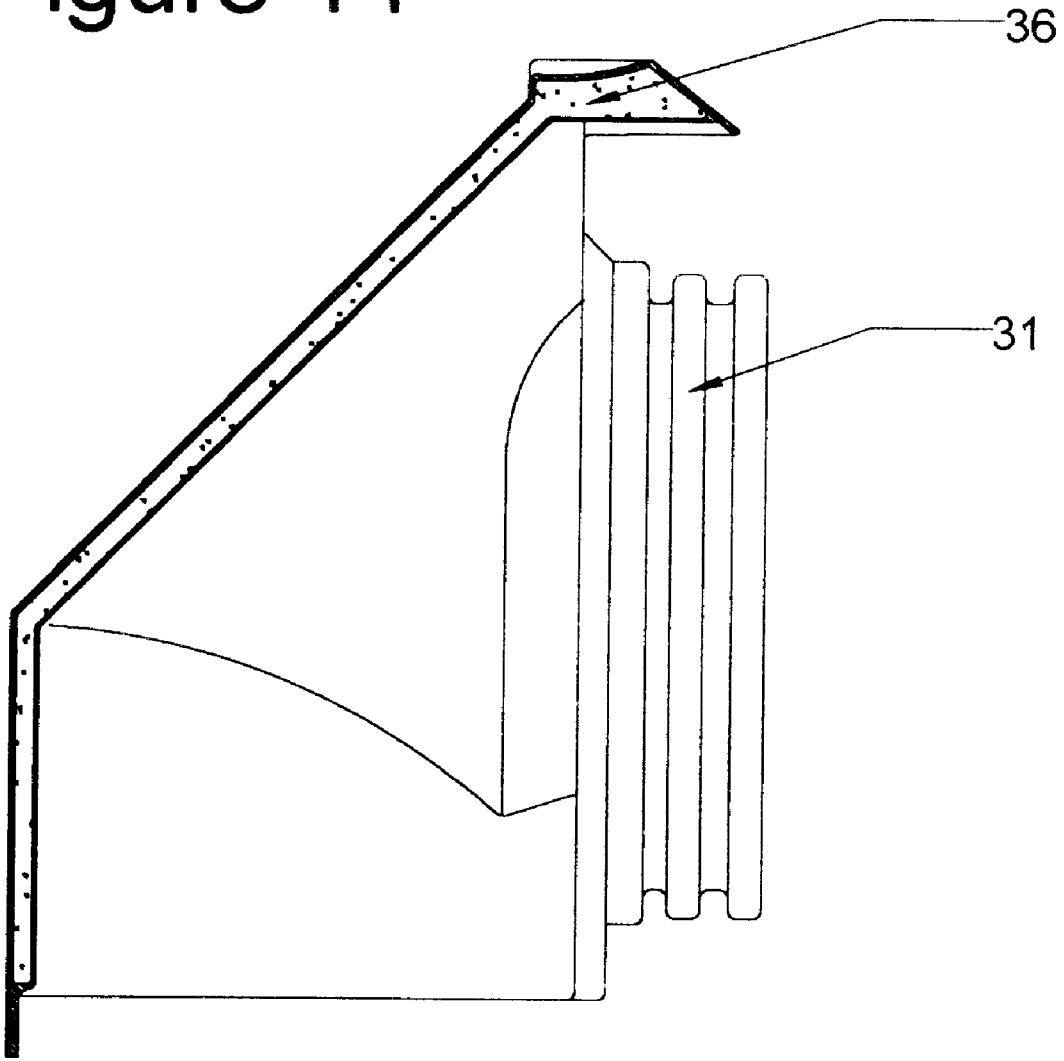
FIG. 14 is a schematic side elevation section view of the headwall shown in FIG. 8 along section line 2C—2C of FIG. 9.

As will be seen in FIG. 8, a second preferred embodiment of a headwall according to the invention, generally indicated as 50, differs from the first embodiment previously described in that interior wall surfaces of sidewall wings 32, 33 are generally concave and the top edges of the sidewall wings 32, 33 are generally arcuate. The back wall 30 of the headwall 50 containing the spigot 31 continues to be planar, but the sidewall wings 32 and 33 are generally cylindrically shaped or otherwise suitably curved. The sidewall wings 32, 33 with the headwall 50 may instead together form a single curved continuum if desired. Side brace panels 34 and 35 similarly may optionally be formed with a generally cylindrical or other curvature. Such curvature assists in funnelling the flowing water over the tray 37. The top flanged crosspiece 36 desirably continues the curve of sidewall wings 32 and 33 and as before adds to the rigidity of the structure in the vicinity of the top of back wall 30.

As in the case of the first embodiment, the headwall 50 is fabricated from a lightweight reinforced composite with cores of polymer concrete introduced where desirable, and coated with a gel coat to provide protection against environmental damage.

It can be seen from viewing the illustrations of this second embodiment of the headwall that the overall relative dimensions, configuration and juxtaposition of front and side brace elements and the tray are very similar to those of the first embodiment, so the various physical characteristics and interrelationships of these elements need not be re-described. Note that while the wings and bracing elements are shown as discrete surfaces, they could form a curved continuum. Note also that relative dimensions and preferred angles will be expected to vary considerably from one installation site to another, whether the first or second embodiment or any other embodiment of the invention is employed.

Figures 15A, 15B:
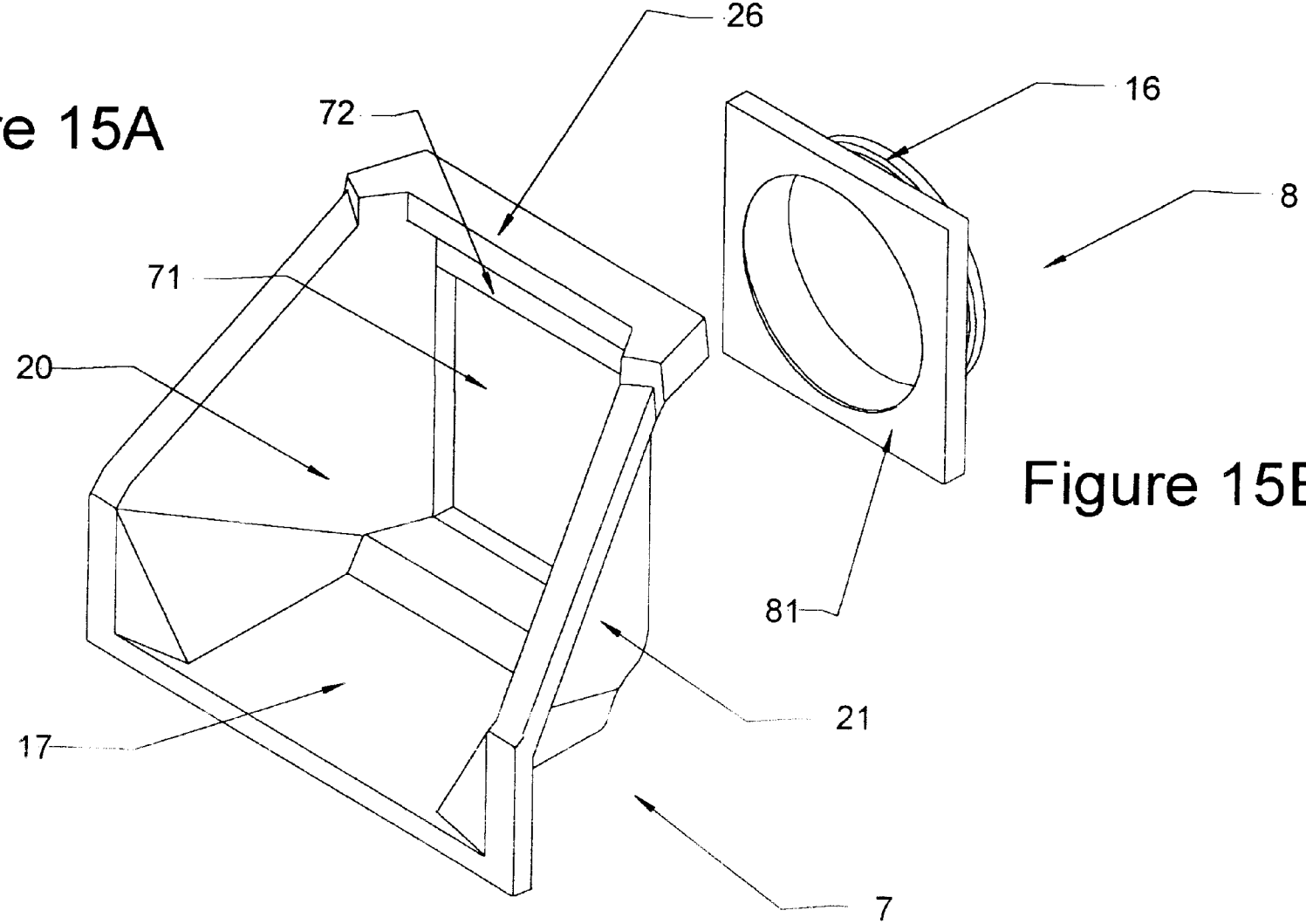
FIG. 15A is a schematic isometric view of a body component of a headwall structure in another embodiment of the present invention, in which the headwall consists of a body component and a spigot component to be coupled together.
FIG. 15B is a schematic isometric view of a spigot component of a headwall structure in another embodiment of the present invention, in which the headwall consist of a body component and a spigot component to be coupled together.

As illustrated in FIGS. 15A and 15B, the headwall may be formed as a two-component structure, namely a body part (component) 7 and a spigot part (component) 8. The spigot component 8 consists of a spigot 16 and an immediately adjoining flanged wall 81 having a central circular aperture of the same internal diameter as that of the spigot 16 and a square periphery. The flanged wall 81 forms a mating part of the back wall 72 of the headwall after the spigot portion 8 is inserted and affixed into a square aperture 71 in the body component 7 (FIG. 15A) whose dimensions are very slightly oversize relative to those of the periphery of the flanged wall 81 to permit ready insertion of the spigot component 8 into the aperture 71 for a mating fit. At or before installation, the spigot component 8 after insertion into the aperture 71 is bonded and fastened in place by any known convenient means. The choice of bonding agents and fasteners is not per se a part of the present invention. By thus designing the two-component embodiment of FIGS. 15A and 15B, any selected spigot component 8 having a spigot 16 of desired size and configuration may be coupled with the body component 7 to form a headwall structure that can be matingly interconnected with a pipe of a particular terminal style by means of a standard double-female coupling that mates with both the spigot 16 and the pin end of a pipe section manufactured to the same specifications. All other parts of the body portion 7 of the headwall structure (i.e., sidewall wings 21 and 20, the tray 17, the top flange 26) may be similar to the parts of the headwall 10 illustrated in FIGS. 1–7 and described above.

Not illustrated in the drawings of either of the preferred embodiments illustrated but conveniently provided are attachment lugs, brackets, slots, apertures, eyes, etc. to enable auxiliary devices such as trash gates, security grids and weir boards to be attached to the headwall structure.

Other variants and modifications will readily occur to those skilled in headwall design and plastics composites structural design.

What is claimed is:

1. A prefabricated headwall structure formed as an integral unit and comprising:

a back wall with an opening for accommodating a flow of water;

a tray joined to the lower edge of the back wall and extending generally horizontally outwardly therefrom;

a pair of sidewalls joining the back wall and the tray and extending outwardly from the back wall and defining with the tray a water flow channel;

each said sidewall including (i) an upper wing;

(ii) a side brace panel providing bracing for the wing, the side brace panel extending obliquely from an edge on the interior surface of the associated one of the sidewalls below the top edge of the associated sidewall to an edge on the tray; and (iii) a front brace panel having a common edge with the forward edge of the side brace panel and a lower edge meeting a respective outer side portion of the tray.

2. A headwall structure according to claim 1, wherein the sidewall wings outwardly diverge from the back wall.

3. A headwall structure according to claim 2, wherein the upper edge of each said side brace panel is higher at the front than at the rear of said upper edge, thereby in exit mode limiting divergence of effluent water as it flows outwardly from the back wall, and in entrance mode facilitating convergence of incoming water.

4. A headwall structure according to claim 1, additionally comprising marginal flanges along selected edges of the structure.

5. A headwall structure according to claim 4 for installation in association with an adjoining embankment, wherein said marginal flanges include marginal flanges adjoining the front brace panels, and wherein the front brace panels and marginal flanges adjoining the front brace panels lie generally parallel to the slope of the embankment.

6. A headwall structure according to claim 1, wherein at least the surface portions of the elements of the headwall structure are constructed of lightweight reinforced composite material.

7. A headwall structure according to claim 4, wherein at least the surface portions of the elements of the headwall structure are constructed of lightweight reinforced composite material.

8. A headwall structure according to claim 1, constructed of lightweight reinforced composite material incorporating selected cores of selected core material in selected portions of the structure.

9. A headwall structure according to claim 4, constructed of lightweight reinforced composite material incorporating selected cores of selected core material in selected portions of the structure.

10. A headwall structure according to claim 1, constructed of lightweight reinforced composite material incorporating rigid polymer concrete cores in selected portions of the structure.

11. A headwall structure according to claim 10, wherein the polymer concrete cores constitute a framework for the headwall structure.

12. A headwall structure according to claim 4, constructed of lightweight reinforced composite material incorporating rigid polymer concrete cores in selected portions of the structure.

13. A headwall structure according to claim 12, wherein the polymer concrete cores constitute a framework for the headwall structure.

14. A headwall structure according to claim 1, wherein surface portions of the structure are coated with a gel coat for protection of such surface portions.

15. A headwall structure according to claim 1, wherein interior wall surfaces of the sidewall wings are generally concave and the top edges of the sidewall wings are generally arcuate.

16. A headwall structure according to claim 1, additionally comprising a spigot for coupling to a mating pipe, the spigot surrounding the said opening in the back wall and integral with the back wall and projecting therefrom in a sense opposite to that in which the wings and tray extend from the back wall.

17. A headwall structure according to claim 16, wherein a spigot is interconnectable with a pipe of a selected connection configuration at the spigot's terminating end by means of a double female coupling element.

18. A headwall structure according to claim 1, generally symmetrical about a generally vertical plane bisecting the structure longitudinally.

19. A headwall structure according to claim 1, wherein the front panels are inwardly inclined so that when the headwall structure is installed in entrance mode, the water flow upstream of the tray is inwardly directed into the flow channel.

20. A headwall structure for a drain or culvert accommodating a flow of water, comprising:

a back wall with an opening for accommodating the flow of water;

a tray joined to the lower edge of the back wall and extending generally horizontally outwardly therefrom;

a pair of sidewalls joining the back wall and the tray and extending outwardly from the back wall;

for each said sidewall, a set of brace elements providing bracing for the associated sidewall, the brace elements interconnecting the associated sidewall to the tray;

the back wall, tray, sidewalls and brace elements together defining the back, bottom and side surfaces of a flow channel for the flow of water.

21. A headwall structure as defined in claim 20, wherein the brace elements are panels interconnected to one another at one or more obtuse angles.

22. A headwall structure as defined in claim 20, wherein the sidewalls are curved and have arcuate upper edges.

23. A headwall structure as defined in claim 20, wherein each said sidewall and associated said brace elements are together formed as a single continuously curved surface.

24. A headwall structure as defined in claim 21, formed as an integral unit.

25. A headwall structure as defined in claim 22, formed as an integral unit.

26. A headwall structure for a drain or culvert accommodating a flow of water, comprising:

a back wall with an opening for accommodating the flow of water;

a tray joined to the lower edge of the back wall and extending generally horizontally outwardly therefrom;

a pair of sidewalls joining the back wall and the tray and extending outwardly from the back wall;

for each said sidewall, a set of brace elements providing bracing for the associated sidewall, the brace elements interconnecting the associated sidewall to the tray;

inside surfaces of the back wall, tray, sidewalls and brace elements together defining the back, bottom and side surfaces of a flow channel for the flow of water; and outside surfaces of the lower outer portions of the sidewalls and brace elements together defining a pair of lower outer recesses on either side of the headwall structure which, upon installation of the headwall structure, constitute receptacles for earth or fill to help stabilize the headwall structure.

27. A headwall structure as defined in claim 26, wherein the said recesses are each bounded at the front outer part thereof by a front surface of the headwall structure lying generally perpendicular to the flow of water and against which backfill may be applied upon installation of the headwall structure to help anchor the headwall structure in place.

28. A headwall structure as defined in claim 26, formed as an integral unit.

29. A headwall structure as defined in claim 27, formed as an integral unit.

30. A headwall structure as defined in claim 26, wherein each of the sidewalls and associated brace elements are curved to form a curved continuum.

31. A headwall structure as defined in claim 26, wherein (i) each said sidewall includes an upper wing;

(ii) the brace elements for such sidewall include a side brace element and a front brace element;

(iii) the surfaces of at least the side brace element and wing of each sidewall are curved surfaces; and (iv) the wing of each sidewall has a curved upper edge.

32. A prefabricated headwall structure formed as a two-component structure, comprising:

(a) a spigot component having (i) a spigot for coupling to a mating pipe and (ii) a flanged wall portion with an opening generally coincident with the spigot opening for accommodating a flow of water, the spigot surrounding the opening in said wall portion and fixed to the wall portion and projecting therefrom; and (b) a headwall body component having (i) a back wall with an aperture for receiving and accommodating said spigot component in a mating engagement; (ii) a tray joined to the lower edge of the back wall and extending generally horizontally outwardly therefrom on the side of the back wall opposite that from which the spigot projects; and (iii) a pair of sidewalls joining the back wall and the tray and extending outwardly from the back wall and defining with the tray a water flow channel;

said components when assembled together having the spigot component inserted and affixed into the aperture in the headwall body component so that the spigot extends from the back wall of the headwall in a sense opposite to that in which the wings and tray extend from the back wall so as to accommodate water flow through the assembled components.

33. A headwall structure as defined in claim 32, wherein the periphery of the flanged wall portion is square and the aperture is a square aperture mating with the periphery of the flanged wall portion.

34. A headwall structure as defined in claim 32, each said sidewall including (i) an upper wing;

(ii) a side brace panel providing bracing for the wing, the side brace panel extending obliquely from an edge on the interior surface of the associated one of the sidewalls below the top edge of the associated sidewall to an edge on the tray; and (iii) a front brace panel having a common edge with the forward edge of the side brace panel and a lower edge meeting a respective outer side portion of the tray.

35. A headwall structure according to claim 34, wherein the sidewall wings outwardly diverge from the back wall.

36. A headwall structure according to claim 35, wherein the upper edge of each said side brace panel is higher at the front than at the rear of said upper edge, thereby in exit mode limiting divergence of effluent water as it flows outwardly from the back wall, and in entrance mode facilitating convergence of incoming water.

37. A headwall structure according to claim 36, additionally comprising marginal flanges along selected edges of the structure.

38. A headwall structure according to claim 37 for installation in association with an adjoining embankment, wherein said marginal flanges include marginal flanges adjoining the front brace panels, and wherein the front brace panels and marginal flanges adjoining the front brace panels lie generally parallel to the slope of the embankment.

39. A headwall structure according to claim 32, wherein at least the surface portions of the elements are constructed of lightweight reinforced composite material.

40. A headwall structure according to claim 38, wherein at least the surface portions of the elements are constructed of lightweight reinforced composite material.

* * * * *

UNITED STATES PATENT AND TRADEMARK OFFICE

CERTIFICATE OF CORRECTION

PATENT NO. : 6,533,498 B1
DATED : March 18, 2003
INVENTOR(S) : Quin, Donald S.

It is certified that error appears in the above-identified patent and that said Letters Patent is hereby corrected as shown below:

Title page,
Item [54], Title, "REINFORCED COMPOSITE MATERIAL" should read
-- REINFORCED COMPOSITE HEADWALL --.

Signed and Sealed this

Thirtieth Day of December, 2003

JAMES E. ROGAN
*Director of the United States Patent and Trademark Office*